US010919329B2

(12) United States Patent
Kurihara et al.

(10) Patent No.: US 10,919,329 B2
(45) Date of Patent: Feb. 16, 2021

(54) OPTICAL APPARATUS, RENDERING AND ERASING APPARATUS, AND IRRADIATION METHOD

(71) Applicant: Sony Corporation, Tokyo (JP)

(72) Inventors: Kenichi Kurihara, Kanagawa (JP); Aya Shuto, Kanagawa (JP); Nobukazu Hirai, Kanagawa (JP); Yuki Oishi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/619,598

(22) PCT Filed: Apr. 17, 2018

(86) PCT No.: PCT/JP2018/015877
§ 371 (c)(1),
(2) Date: Dec. 5, 2019

(87) PCT Pub. No.: WO2018/225386
PCT Pub. Date: Dec. 13, 2018

(65) Prior Publication Data

US 2020/0147989 A1 May 14, 2020

(30) Foreign Application Priority Data

Jun. 8, 2017 (JP) ..... JP2017-113452

(51) Int. Cl.
*B41J 2/455* (2006.01)
*B41M 7/00* (2006.01)

(52) U.S. Cl.
CPC ..... *B41M 7/0009* (2013.01); *B41J 2/455* (2013.01)

(58) Field of Classification Search
CPC ..... B41J 2/455; B41M 7/0009
See application file for complete search history.

(56) References Cited

U.S. PATENT DOCUMENTS 5,066,962 A 11/1991 Sarraf

FOREIGN PATENT DOCUMENTS

| | | |
|---|---|---|
| JP | 2003266952 | 9/2003 |
| JP | 2003266952 A | 9/2003 |
| JP | 2004074584 A | 3/2004 |
| JP | 2004188827 | 7/2004 |
| JP | 2004188827 A | 7/2004 |
| JP | 2009172801 | 8/2009 |
| JP | 2009172801 A | 8/2009 |
| JP | 2011-104995 | 6/2011 |

OTHER PUBLICATIONS

International Search Report for Application No. PCT/JP2018/015877, dated May 29, 2018.

*Primary Examiner* — Lamson D Nguyen
(74) *Attorney, Agent, or Firm* — K&L Gates LLP

(57) ABSTRACT

An optical apparatus according to an embodiment of the present disclosure is an apparatus that performs one or both of writing and erasing of information with respect to a reversible recording medium. This optical apparatus includes a plurality of laser devices varying in emission wavelength in a near infrared region (700 nm to 2500 nm), an optical system that multiplexes laser beams outputted from the plurality of laser devices, and a scanner unit that scans a multiplexed light beam obtained by multiplexing by the optical system, on the reversible recording medium.

9 Claims, 9 Drawing Sheets

[ FIG. 1 ]
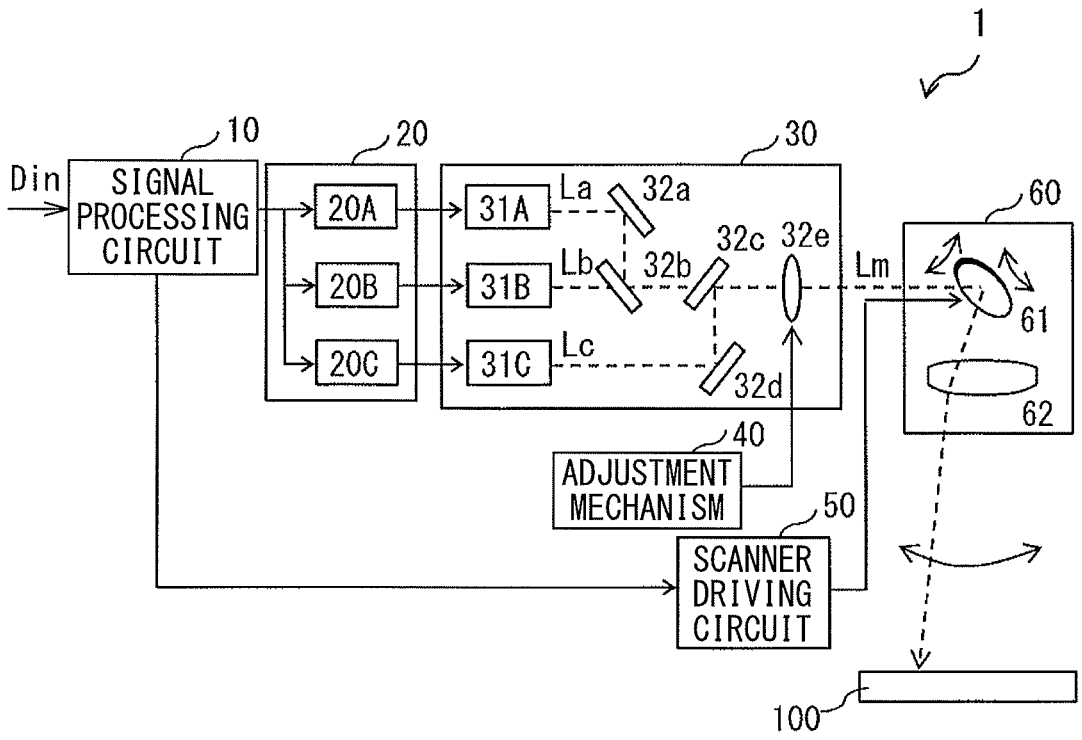
[ FIG. 2 ]
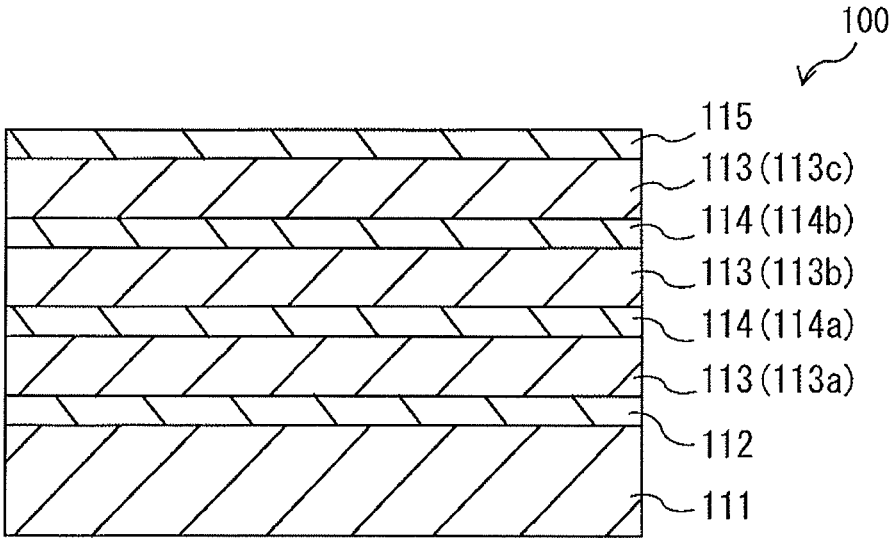
RECORDING LAYER 113 INCLUDING 100A AND 100B

[ FIG. 3 ]
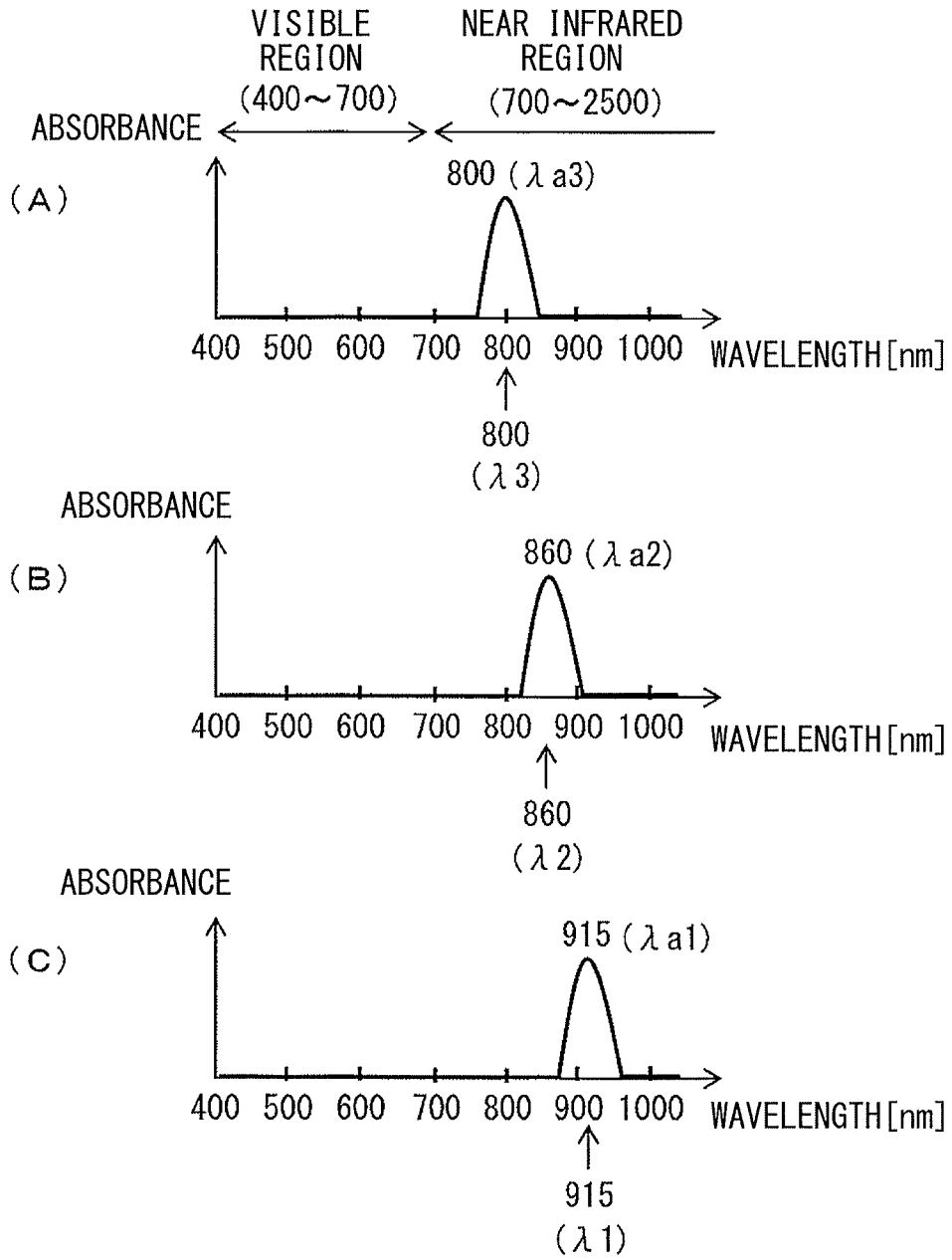

[ FIG. 4 ]
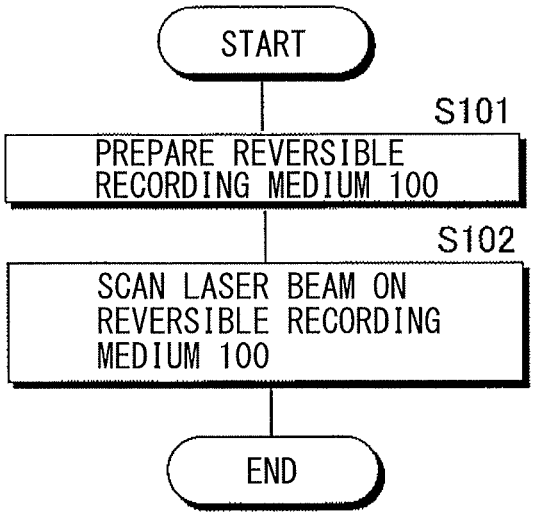
[ FIG. 5 ]
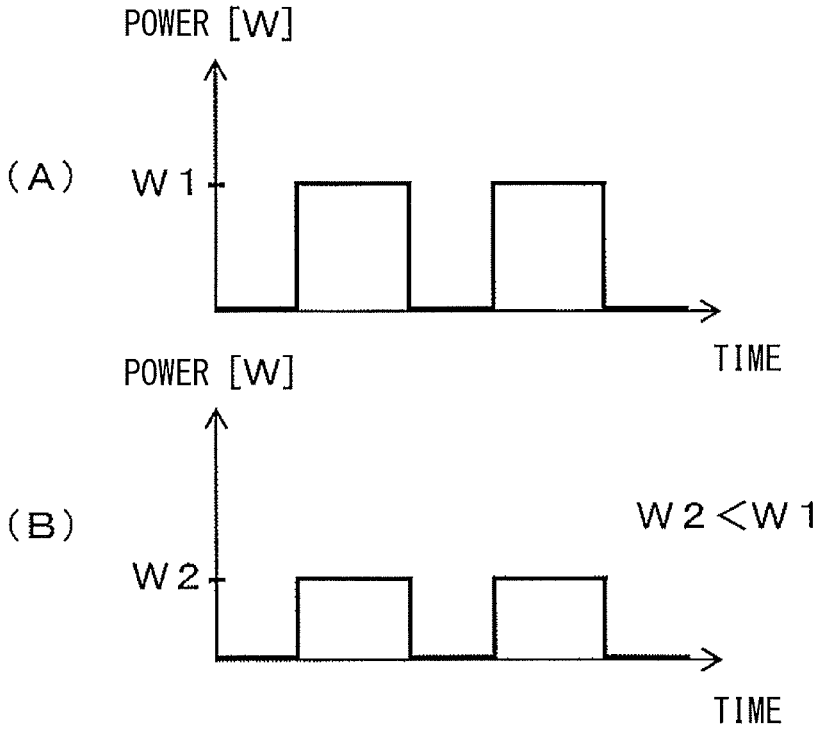

[ FIG. 6 ]
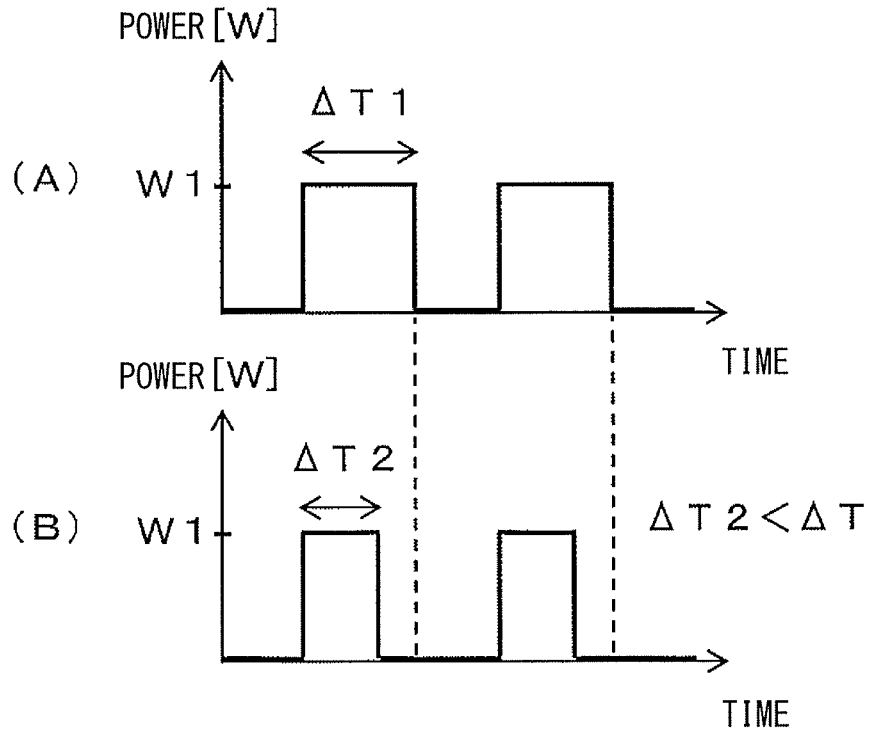
[ FIG. 7 ]
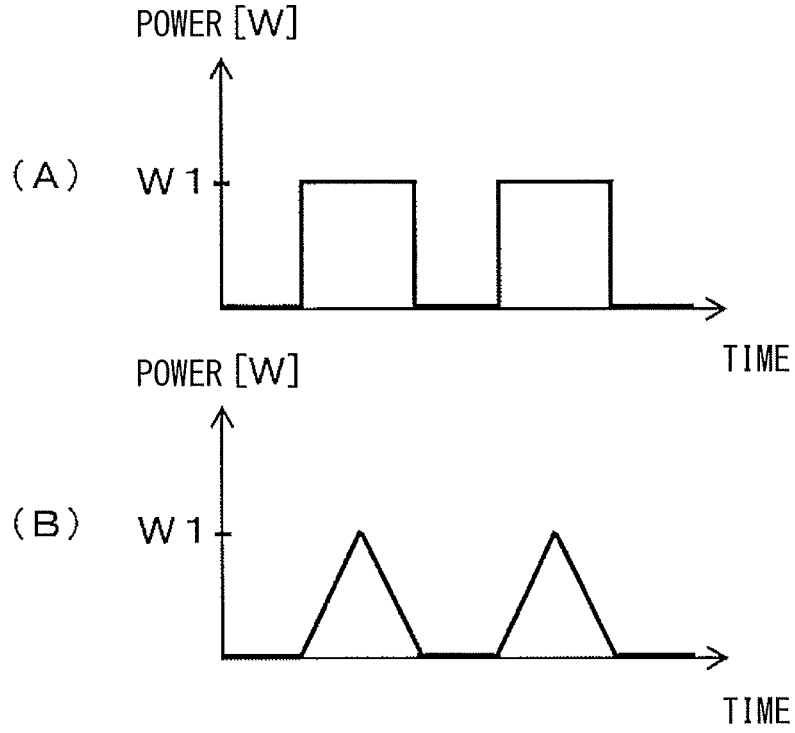

[ FIG. 8 ]
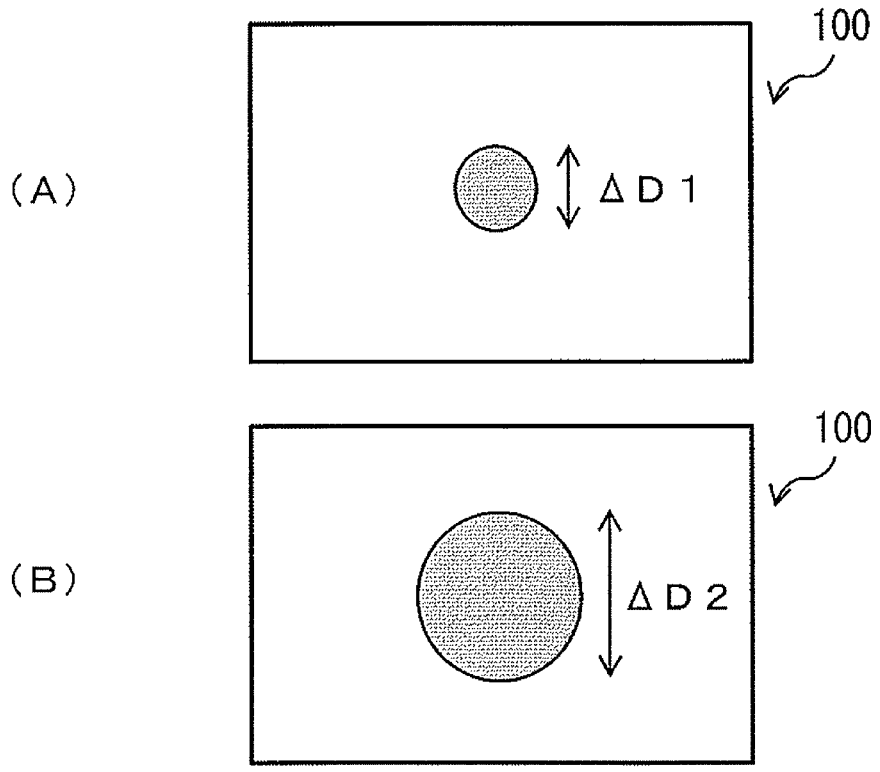

[ FIG. 9 ]

| | WAVE-LENGTH (nm) | POWER (W) | SPOT DIAMETER (μm) | SCAN SPEED (m/s) | DISPLAYED HUE | REFLECTION DENSITY AFTER DRAWING |
|---|---|---|---|---|---|---|
| EXAMPLE 1 | 800 | 2 | 70 | 5 | BLACK | 1.8 |
| | 860 | 2 | 70 | | | |
| | 915 | 2 | 70 | | | |
| EXAMPLE 2 | 800 | 2 | 70 | 5 | YELLOW | 1.1 |
| | 860 | — | 70 | | | |
| | 915 | — | 70 | | | |
| EXAMPLE 3 | 800 | — | 70 | 5 | MAGENTA | 1.5 |
| | 860 | — | 70 | | | |
| | 915 | 2 | 70 | | | |
| EXAMPLE 4 | 800 | — | 70 | 5 | CYAN | 1.5 |
| | 860 | 2 | 70 | | | |
| | 915 | — | 70 | | | |
| EXAMPLE 5 | 800 | 2 | 70 | 5 | RED | 1.6 |
| | 860 | — | 70 | | | |
| | 915 | 2 | 70 | | | |
| EXAMPLE 6 | 800 | — | 70 | 5 | BLUE | 1.7 |
| | 860 | 2 | 70 | | | |
| | 915 | 2 | 70 | | | |
| EXAMPLE 7 | 800 | 2 | 70 | 5 | GREEN | 1.5 |
| | 860 | 2 | 70 | | | |
| | 915 | — | 70 | | | |
| EXAMPLE 8 | 800 | 2 | 70 | 5 | BLACK | 1.8 |
| | 860 | 2 | 70 | | | |
| | 915 | 2 | 70 | | | |
| EXAMPLE 9 | 800 | 2 | 70 | 5 | BLACK | 1.8 |
| | 860 | 2 | 70 | | | |
| | 915 | 2 | 70 | | | |
| EXAMPLE 10 | 800 | 2 | 70 | 5 | BLACK | 1.8 |
| | 860 | 2 | 70 | | | |
| | 915 | 2 | 70 | | | |

[ FIG. 10 ]

| | WAVE-LENGTH (nm) | POWER (W) | SPOT DIAMETER (μm) | SCAN SPEED (m/s) | DISPLAYED HUE | REFLE-CTION DENSITY AFTER ERASING |
|---|---|---|---|---|---|---|
| EXAMPLE 11 | 800 | 2 | 500 | 0.5 | — | 0.15 |
| | 860 | 2 | 500 | | | |
| | 915 | 2 | 500 | | | |
| EXAMPLE 12 | 800 | 2 | 500 | 0.5 | — | 0.11 |
| | 860 | 2 | 500 | | | |
| | 915 | — | 500 | | | |
| EXAMPLE 13 | 800 | — | 500 | 0.5 | — | 0.13 |
| | 860 | — | 500 | | | |
| | 915 | 2 | 500 | | | |
| EXAMPLE 14 | 800 | — | 500 | 0.5 | — | 0.13 |
| | 860 | 2 | 500 | | | |
| | 915 | — | 500 | | | |
| EXAMPLE 15 | 800 | 2 | 500 | 0.5 | — | 0.13 |
| | 860 | — | 500 | | | |
| | 915 | 2 | 500 | | | |
| EXAMPLE 16 | 800 | — | 500 | 0.5 | — | 0.14 |
| | 860 | 2 | 500 | | | |
| | 915 | 2 | 500 | | | |
| EXAMPLE 17 | 800 | 2 | 500 | 0.5 | — | 0.14 |
| | 860 | 2 | 500 | | | |
| | 915 | — | 500 | | | |
| EXAMPLE 18 | 800 | 2 | 1000 | 0.8 | — | 0.15 |
| | 860 | 2 | 1000 | | | |
| | 915 | 2 | 1000 | | | |
| EXAMPLE 19 | 800 | 2 | 2000 | 1.2 | — | 0.14 |
| | 860 | 2 | 2000 | | | |
| | 915 | 2 | 2000 | | | |
| EXAMPLE 20 | 800 | 3 | 500 | 0.7 | — | 0.15 |
| | 860 | 3 | 500 | | | |
| | 915 | 3 | 500 | | | |

[ FIG. 11 ]

| | WAVE-LENGTH (nm) | POWER (W) | SPOT DIAMETER (μm) | SCAN SPEED (m/s) | DISPLAYED HUE | REFLECTION DENSITY AFTER DRAWING |
|---|---|---|---|---|---|---|
| COMPA-RATIVE EXAMPLE 1 | 800 | 2 | 70 | 5 | BLACK | 1.4 |
| | 860 | 2 | 70 | | | |
| | 915 | 2 | 70 | | | |
| COMPA-RATIVE EXAMPLE 2 | 800 | 2 | 70 | 5 | RED | 1.1 |
| | 860 | 2 | 70 | | | |
| | 915 | — | 70 | | | |
| COMPA-RATIVE EXAMPLE 3 | 800 | — | 70 | 5 | BLUE | 1.2 |
| | 860 | — | 70 | | | |
| | 915 | 2 | 70 | | | |
| COMPA-RATIVE EXAMPLE 4 | 800 | — | 70 | 5 | GREEN | 1.1 |
| | 860 | 2 | 70 | | | |
| | 915 | — | 70 | | | |

[ FIG. 12 ]

| | WAVE-LENGTH (nm) | POWER (W) | SPOT DIAMETER (μm) | SCAN SPEED (m/s) | DISPLAYED HUE | REFLECTION DENSITY AFTER ERASING |
|---|---|---|---|---|---|---|
| COMPA-RATIVE EXAMPLE 5 | 800 | 2 | 500 | 0.5 | — | 0.35 |
| | 860 | 2 | 500 | | | |
| | 915 | 2 | 500 | | | |
| COMPA-RATIVE EXAMPLE 6 | 800 | 2 | 500 | 0.5 | — | 0.25 |
| | 860 | — | 500 | | | |
| | 915 | 2 | 500 | | | |
| COMPA-RATIVE EXAMPLE 7 | 800 | — | 500 | 0.5 | — | 0.27 |
| | 860 | 2 | 500 | | | |
| | 915 | 2 | 500 | | | |
| COMPA-RATIVE EXAMPLE 8 | 800 | 2 | 500 | 0.5 | — | 0.23 |
| | 860 | 2 | 500 | | | |
| | 915 | — | 500 | | | |

[ FIG. 13 ]

| | ERASING CONDITION | SCAN SPEED (m/s) | DISPLAYED HUE | REFLE-CTION DENSITY AFTER ERASING | REMARKS |
|---|---|---|---|---|---|
| COMPARATIVE EXAMPLE 9 | ERASING USING CERAMIC BAR FOR ERASING | 0.001 | — | 0.15 | DEFORMATION OF BASE MATERIAL |
| COMPARATIVE EXAMPLE 10 | ERASING USING CERAMIC BAR FOR ERASING | 0.01 | LIGHT PINK | 0.35 | PRESENCE OF UNERASED PORTION |

OPTICAL APPARATUS, RENDERING AND ERASING APPARATUS, AND IRRADIATION METHOD

TECHNICAL FIELD

The present disclosure relates to an optical apparatus, a rendering and erasing apparatus, and an irradiation method.

BACKGROUND ART

A recording medium employing a heat-sensitive method and using a heat-sensitive color developing composition such as a leuco dye has become widespread (e.g., see PTL 1 to PTL 3). Currently, for such a recording medium, an irreversible recording medium not enabling data to be erased once written, and a reversible recording medium enabling repeated rewriting have become practical. As for the reversible recording medium, while monochromatic display has become practical, full color display has not yet become practical.

CITATION LIST

Patent Literature

PTL 1: Japanese Unexamined Patent Application Publication No. 2004-74584

PTL 2: Japanese Unexamined Patent Application Publication No. 2004-188827

PTL 3: Japanese Unexamined Patent Application Publication No. 2011-104995

SUMMARY OF THE INVENTION

Incidentally, when an excessive amount of heat is applied to a recording medium employing a heat-sensitive method during writing or erasing, there is a possibility that the recording medium deforms. Therefore, it is desirable to provide an optical apparatus, a rendering and erasing apparatus, and an irradiation method that make it possible to suppress deformation of a recording medium.

An optical apparatus according to an embodiment of the present disclosure is an apparatus that performs one or both of writing and erasing of information with respect to a reversible recording medium. Here, the reversible recording medium includes a plurality of recording portions including a reversible heat-sensitive color developing composition and a photothermal conversion agent. In this reversible recording medium, further, the reversible heat-sensitive color developing composition varies in developed-color tone for each of the recording portions, and the photothermal conversion agent varies in absorption wavelength for each of the recording portions in a near infrared region (700 nm to 2500 nm). The optical apparatus includes a plurality of laser devices varying in emission wavelength in a near infrared region, an optical system that multiplexes laser beams outputted from the plurality of laser devices, and a scanner unit that scans a multiplexed light beam obtained by multiplexing by the optical system, on the reversible recording medium.

A rendering and erasing apparatus according to an embodiment of the present disclosure includes a plurality of laser devices varying in emission wavelength in a near infrared region, an optical system that multiplexes laser beams outputted from the plurality of laser devices, and a scanner unit that scans a multiplexed light beam obtained by multiplexing by the optical system, on a reversible recording medium.

A rendering method according to an embodiment of the present disclosure includes performing, with respect to a reversible recording medium including a plurality of recording portions including a reversible heat-sensitive color developing composition and a photothermal conversion agent, the reversible heat-sensitive color developing composition varying in developed-color tone for each of the recording portions, and the photothermal conversion agent varying in absorption wavelength for each of the recording portions in a near infrared region (700 nm to 2500 nm), the following. That is to perform one or both of writing and erasing of information, by multiplexing laser beams outputted from a plurality of laser devices varying in emission wavelength in a near infrared region, and scanning a multiplexed light beam obtained thereby, on the reversible recording medium.

In the optical apparatus, the rendering and erasing apparatus, and the rendering method according to the respective embodiments of the present disclosure, the laser beams outputted from the plurality of laser devices varying in emission wavelength in the near infrared region are multiplexed, and scanning of the multiplexed light beam obtained thereby is performed on the reversible recording medium. In this way, driving the laser devices simultaneously increases writing efficiency or erasing efficiency in terms of thermal diffusion, as compared with a case where each of the laser devices is driven in temporally independently. This reduces energy necessary for writing and erasing.

According to the optical apparatus, the rendering and erasing apparatus, and the rendering method in the respective embodiments of the present disclosure, the energy necessary for writing and erasing is reduced and thus, it is possible to suppress deformation of a recording medium. It is to be noted that effects of the present disclosure are not limited to those described above, and may be any of effects described in the present specification.

BRIEF DESCRIPTION OF DRAWINGS

FIG. 1 illustrates a schematic configuration example of a rendering apparatus according to an embodiment of the present disclosure.

FIG. 2 illustrates a cross-sectional configuration example of a reversible recording medium.

FIG. 3 illustrates an example of an absorption wavelength of each of recording layers included in the reversible recording medium.

FIG. 4 illustrates an example of a procedure of irradiating the reversible recording medium with a laser beam.

FIG. 5 illustrates examples of an optical output waveform of a light source unit.

FIG. 6 illustrates examples of an optical output waveform of the light source unit.

FIG. 7 illustrates examples of an optical output waveform of the light source unit.

FIG. 8 illustrates examples of a light spot formed by an optical output of the light source unit.

FIG. 9 illustrates results of writing experiments according to Examples.

FIG. 10 illustrates results of erasing experiments according to Examples.

FIG. 11 illustrates results of writing experiments according to comparative examples.

FIG. 12 illustrates results of erasing experiments according to comparative examples.

FIG. 13 illustrates results of erasing experiments according to comparative examples.

MODES FOR CARRYING OUT THE INVENTION

Some embodiments of the present disclosure are described below in detail with reference to the drawings. The following description is a specific example of the disclosure, and the disclosure is not limited to the following implementation.

1. Embodiment

[Configuration]

A rendering apparatus 1 according to an embodiment of the present disclosure is described. The rendering apparatus 1 corresponds to a specific example of a "rendering and erasing apparatus" of the present disclosure. FIG. 1 illustrates a system configuration example of the rendering apparatus 1 according to the present embodiment. The rendering apparatus 1 performs writing and erasing of information with respect to a reversible recording medium 100. First, the reversible recording medium 100 is described, and subsequently, the rendering apparatus 1 is described.

(Reversible Recording Medium 100)

FIG. 2 illustrates a configuration example of each of layers included in the reversible recording medium 100. The reversible recording medium 100 includes a plurality of recording layers 133 varying in developed-color tone. The recording layer 113*c* corresponds to a specific example of a "recording portion" of the present disclosure. The reversible recording medium 100 has, for example, a structure in which the recording layer 113 and a heat insulating layer 114 are alternately laminated on a base material 110.

The reversible recording medium 100 includes, for example, a primary layer 112, the three recording layers 113 (113*a*, 113*b*, and 113*c*), the two heat insulating layers 114 (114*a* and 114*b*), and a protective layer 115, on the base material 110. The three recording layers 13 (113*a*, 113*b*, and 113*c*) are disposed in order of the recording layer 113*a*, the recording layer 113*b*, and the recording layer 113*c*, from side of the base material 110. The two heat insulating layers 114 (114*a* and 114*b*) are disposed in order of the heat insulating layer 114*a* and the heat insulating layer 114*b*, from side of the base material 110. The primary layer 112 is formed in contact with a surface of the base material 110. The protective layer 115 is formed on an outermost surface of the reversible recording medium 100.

The base material 110 supports each of the recording layers 113 and each of the heat insulating layers 114. The base material 110 serves as a substrate for formation of each layer on a surface thereof. The base material 110 may allow light to pass therethrough or may not allow light to pass therethrough. In a case where the light is not allowed to pass therethrough, a color of the surface of the base material 110 may be, for example, white, or may be a color other than white. The base material 110 includes, for example, an ABS resin. The primary layer 112 has a function of improving adhesiveness between the recording layer 113*a* and the base material 110. The primary layer 112 includes, for example, a material that allows light to pass therethrough.

The three recording layers 113 (113*a*, 113*b*, and 113*c*) make it possible to reversibly change a state between a color-developed state and a discolored state. The three recording layers 113 (113*a*, 113*b*, and 113*c*) are configured to have colors varying in color-developed state. The three recording layers 113 (113*a*, 113*b*, and 113*c*) each include a leuco dye 100A (a reversible heat-sensitive color developing composition), and a photothermal conversion agent 100B (a photothermal conversion agent) that generates heat in writing. The three recording layers 13 (113*a*, 113*b*, and 113*c*) each further include a developer and a polymer.

The leuco dye 100A enters the color-developed state by being combined with the developer by heat, or enters the discolored state by being separated from the developer. A developed-color tone of the leuco dye 100A included in each of the recording layers 113 (113*a*, 113*b*, and 113*c*) varies depending on the recording layer 113. The leuco dye 100A included in the recording layer 113*a* develops into magenta by being combined with the developer by heat. The leuco dye 100A included in the recording layer 113*b* develops into cyan by being combined with the developer by heat. The leuco dye 100A included in the recording layer 113*c* develops into yellow by being combined with the developer by heat. Positional relationships between the three recording layers 113 (113*a*, 113*b*, and 113*c*) are not limited to the above-described example. Further, the three recording layers 113 (113*a*, 113*b*, and 113*c*) become transparent in the discolored state. This enables the reversible recording medium 100 to record an image, using color of a wide color gamut.

The photothermal conversion agent 100B generates heat by absorbing light in a near infrared region (700 nm to 2500 nm). It is to be noted that, in the present specification, the near infrared region indicates a wavelength band of 700 nm to 2500 nm. Absorption wavelengths of the photothermal conversion agents 100B included in the respective recording layers 113 (113*a*, 113*b*, and 113*c*) vary in the near infrared region (700 nm to 2500 nm). FIG. 3 illustrates an example of the absorption wavelength of the photothermal conversion agent 100B included in each of the recording layers 113 (113*a*, 113*b*, and 113*c*). The photothermal conversion agent 100B included in the recording layer 113*c* has, for example, an absorbing peak at 800 nm as illustrated in FIG. 3(A). The photothermal conversion agent 100B included in the recording layer 113*b* has, for example, an absorbing peak at 860 nm as illustrated in FIG. 3(B). The photothermal conversion agent 100B included in the recording layer 113*a* has, for example, an absorbing peak at 915 nm as illustrated in FIG. 3(C). The absorbing peak of the photothermal conversion agent 100B included in each of the recording layers 113 (113*a*, 113*b*, and 113*c*) is not limited to the above-described example.

The heat insulating layer 114*a* is intended to make it difficult for heat to be transferred between the recording layer 113*a* and the recording layer 113*b*. The heat insulating layer 114*b* is intended to make it difficult for heat to be transferred between the recording layer 113*b* and the recording layer 113*c*. The protective layer 115 is intended to protect the surface of the reversible recording medium 100, and serves as an overcoat layer of the reversible recording medium 100. The two heat insulating layers 114 (114*a* and 114*b*) and the protective layer 115 each include a transparent material. The reversible recording medium 100 may include, for example, a resin layer having relatively high rigidity (e.g., a PEN resin layer), etc., right under the protective layer 115.

[Manufacturing Method]

Next, a specific method of manufacturing each of some layers in the reversible recording medium 100 is described.

A coating that contains the following materials was dispersed by using a rocking mill for two hours. The coating obtained thereby was applied by using a wire bar, and subjected to a thermal drying process at 70 degrees Celsius for five minutes. In this way, a recording layer 13 having a thickness of 3 μm was formed.

A coating for formation of the recording layer 113*a* includes the following materials.

Leuco dye (2 parts by weight)

[Chemical Formula 1]

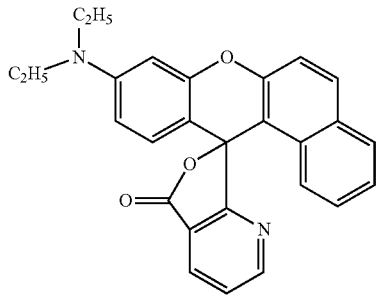

Developing/reducing reagent (4 parts by weight)

[Chemical Formula 2]

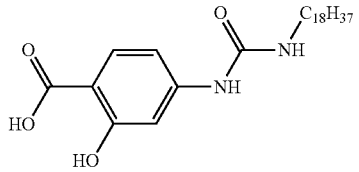

Vinyl chloride-vinyl acetate copolymer (5 parts by weight)

90% vinyl chloride, 10% vinyl acetate, 115000 average molecular weight (M.W.)

Methyl ethyl ketone (MEK) (91 parts by weight)

Photothermal conversion agent

Cyanine infrared absorbing dye: 0.19 parts by weight (made by H. W. SANDS corp., SDA7775, absorption wavelength peak: 933 nm)

A coating for formation of the recording layer 113*b* includes the following materials.

Leuco dye (1.8 parts by weight)

[Chemical Formula 3]

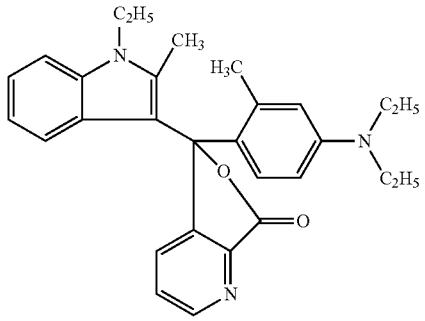

Developing/reducing reagent (4 parts by weight)

[Chemical Formula 4]

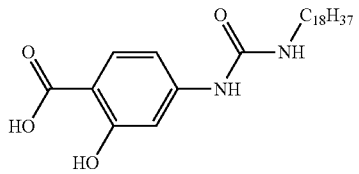

Vinyl chloride-vinyl acetate copolymer (5 parts by weight)

90% vinyl chloride, 10% vinyl acetate, 115000 average molecular weight (M.W.)

Methyl ethyl ketone (MEK) (91 parts by weight)

Photothermal conversion agent

Cyanine infrared absorbing dye: 0.12 parts by weight (made by H. W. SANDS corp., SDA5688, absorption wavelength peak 861 nm)

A coating for formation of the recording layer 113*c* includes the following materials.

Leuco dye 100A (1.3 parts by weight)

[Chemical Formula 5]

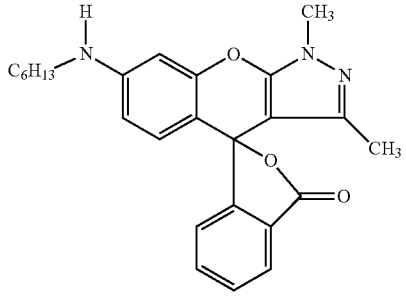

Developing/reducing reagent (4 parts by weight)

[Chemical Formula 6]

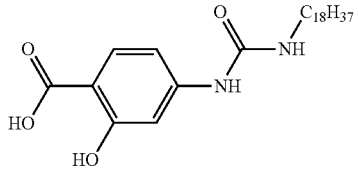

Vinyl chloride-vinyl acetate copolymer (5 parts by weight)

90% vinyl chloride, 10% vinyl acetate, 115000 average molecular weight (M.W.)

Methyl ethyl ketone (MEK) (91 parts by weight)

Photothermal conversion agent

Cyanine infrared absorbing dye: 0.10 parts by weight (made by Nippon Kayaku, CY-10, absorption wavelength peak 798 nm)

A polyvinyl alcohol water solution was applied, and dried. In this way, the heat insulating layer 114 having a thickness of 20 μm was formed. Further, after an ultraviolet curable resin was applied, the resin was irradiated with an ultraviolet ray, and cured. In this way, the protective layer 115 having a thickness of about 2 μm was formed.

(Rendering Apparatus 1)

Next, the rendering apparatus 1 according to the present embodiment is described.

The rendering apparatus 1 includes a signal processing circuit 10, a laser driving circuit 20, a light source unit 30, an adjustment mechanism 40, a scanner driving circuit 50, and a scanner unit 60.

The signal processing circuit 10 controls, for example, a peak value of a current pulse to be applied to the light source unit 30 (e.g., each of light sources 31A, 31B, and 31C described later), etc., depending on characteristics of the reversible recording medium 100, and conditions written in the reversible recording medium 100, together with the laser driving circuit 20. The signal processing circuit 10 generates, for example, an image signal corresponding to properties such as a wavelength of a laser beam, etc., in synchronization with a scanner operation of the scanner unit 50, from an image signal Din inputted from outside. When the rendering apparatus 1 performs writing with respect to the reversible recording medium 100, the image signal Din includes image data to be written in the reversible recording medium 100. When the rendering apparatus 1 performs erasing of written information with respect to the reversible recording medium 10, the image signal Din includes image data for erasing of an image written in the reversible recording medium 100.

The signal processing circuit 10 converts, for example, the input image signal Din into an image signal corresponding to a wavelength of each of the light sources of the light source unit 30 (color gamut conversion). The signal processing circuit 10 generates, for example, a projection image clock signal synchronized with a scanner operation of the scanner unit 50. The signal processing circuit 10 generates, for example, a projection image signal to emit a laser beam according to a generated image signal. The signal processing circuit 10 outputs, for example, the generated projection image signal to the laser driving circuit 20. Further, the signal processing circuit 10 outputs, for example, a projection image clock signal to the laser driving circuit 20, as necessary. Here, "as necessary" is, as described later, a case such as a case where a projection image clock signal is used when a signal source of a high frequency signal is synchronized with an image signal.

The laser driving circuit 20 drives, for example, each of the light sources 31A, 31B, and 31C of the light source unit 30 according to a projection image signal corresponding to each wavelength. The laser driving circuit 20 controls, for example, luminance (light and shade) of a laser beam to draw an image corresponding to a projection image signal. The laser driving circuit 20 includes, for example, a drive circuit 20A that drives the light source 31A, a drive circuit 20B that drives the light source 31B, and a drive circuit 20C that drives the light source 31C. The light sources 31A, 31B, and 31C each output a laser beam in the near infrared region. The light source 31A is, for example, a semiconductor laser that outputs a laser beam La with an emission wavelength λ1. The light source 31B is, for example, a semiconductor laser that outputs a laser beam Lb with an emission wavelength λ2. The light source 31C is, for example, a semiconductor laser that outputs a laser beam Lc with an emission wavelength λ3. The emission wavelengths λ1, λ2, and λ3 satisfy, for example, the following Expression (1), Expression (2), and Expression (3).

$$\lambda a1-20\text{ nm}<\lambda 1<\lambda a1+20\text{ nm} \quad (1)$$

$$\lambda a2-20\text{ nm}<\lambda 2<\lambda a1+20\text{ nm} \quad (2)$$

$$\lambda a1-20\text{ nm}<\lambda 3<\lambda a1+20\text{ nm} \quad (3)$$

Here, λa1 is an absorption wavelength (an absorption peak wavelength) of the recording layer 113*a*, and is, for example, 915 nm. λa2 is an absorption wavelength (an absorption peak wavelength) of the recording layer 113*b*, and is, for example, 860 nm. λa3 is an absorption wavelength (an absorption peak wavelength) of the recording layer 113*c*, and is, for example, 800 nm. It is to be noted that "±10 nm" in each of Expression (1), Expression (2), and Expression (3) indicates a tolerance range. In a case where the emission wavelengths λ1, λ2, and λ3 satisfy Expression (1), Expression (2), and Expression (3), the emission wavelength λ1 is, for example, 915 nm, the emission wavelength λ2 is, for example, 860 nm, and the emission wavelength λ3 is, for example, 800 nm.

The light source unit 30 includes a plurality of light sources varying in emission wavelength in the near infrared region. The light source unit 30 includes, for example, the three light sources 31A, 31B, and 31C. The light source unit 30 further includes, for example, an optical system that multiplexes laser beams outputted from the plurality of light sources (e.g., the three light sources 31A, 31B, and 31C). The light source unit 30 includes, for example, two reflecting mirrors 32*a* and 32*d*, two dichroic mirrors 32*b* and 32*c*, and a lens 32*e*, as such an optical system.

The laser beams La and Lb outputted from the respective two light sources 31A and 31B are, for example, made into substantially parallel light (collimated light) by a collimating lens. Afterward, for example, the laser beam La is reflected by the reflecting mirror 32*a* and reflected by the dichroic mirror 32*b* as well, the laser beam Lb passes through the dichroic mirror 32*b*, and the laser beam La and the laser beam La are thereby multiplexed. A multiplexed light beam including the laser beam La and the laser beam La passes through the dichroic mirror 32*c*.

The laser beam Lc outputted from the light source 31C is, for example, made into substantially parallel light (collimated light) by a collimating lens. Afterward, the laser beam Lc is, for example, reflected by the reflecting mirror 32*d* and reflected by the dichroic mirror 32*c* as well. The above-described multiplexed light beam passing through the dichroic mirror 32*c* and the laser beam Lc reflected by the dichroic mirror 32*c* are thereby multiplexed. A light source unit 32 outputs, for example, a multiplexed light beam Lm obtained by multiplexing by the above-described optical system to the scanner unit 50.

The adjustment mechanism 40 is a mechanism intended to adjust focus of the multiplexed light beam Lm outputted from the light source unit 32. The adjustment mechanism 40 is, for example, a mechanism that adjusts a position of the lens 32*e* by a manual operation performed by a user. It is to be noted that the adjustment mechanism 40 may be a mechanism that adjusts the position of the lens 32*e* by an operation performed by a machine.

The scanner driving circuit 50 drives, for example, the scanner unit 50, in synchronization with a projection image clock signal inputted from the signal processing circuit 10. Further, for example, in a case where a signal for an irradiation angle of a twin scanner 61 described later, etc., is inputted from the scanner unit 60, the scanner driving circuit 40 drives the scanner unit 60 to achieve a desirable irradiation angle, on the basis of the signal.

The scanner unit 60 line-sequentially scans, for example, the multiplexed light beam Lm entering from the light source unit 30, on the surface of the reversible recording medium 100. The scanner unit 60 includes, for example, the twin scanner 61 and an f-θ lens 62. The twin scanner 61 is, for example, a galvanometer mirror. The f-θ lens 62 converts a constant speed rotational motion by the twin scanner 61 into a uniform linear motion of a spot that moves on a focus plane (the surface of the reversible recording medium 100).

Next, writing and erasing of information in the rendering apparatus 1 is described.

[Writing]

First, the reversible recording medium 100 is prepared and set in the rendering apparatus 1 (step S101, FIG. 4). Next, the rendering apparatus 1 outputs, for example, a laser beam from at least one light source among the light source 31A, the light source 31B, and the light source 31C, and scans the laser beam on the reversible recording medium 100 (step S102, FIG. 4). At this moment, in a case where a laser beam is outputted from each of at least two light sources among the light source 31A, the light source 31B, and the light source 31C, the light source unit 30 multiplexes the laser beams outputted from the two light sources, and outputs the multiplexed laser beam. Further, when performing writing with respect to the reversible recording medium 100, the light source unit 30 outputs a laser beam under a condition that a temperature of the recording layer 113 to be subjected to writing is set to be a color developing temperature or higher due to heat generation by the photothermal conversion agent 100B.

As a result, for example, the laser beam La having the emission wavelength of 800 nm is absorbed into the photothermal conversion agent 100B within the recording layer 113*c*, and the leuco dye 100A within the recording layer 113*c* thereby arrives at a writing temperature due to heat generated from the photothermal conversion agent 100B, and develops yellow by being combined with the developer. A yellow development density depends on strength of the laser beam La having the emission wavelength of 800 nm. Further, for example, the laser beam Lb having the emission wavelength of 860 nm is absorbed into the photothermal conversion agent 100B within the recording layer 113*b*, and the leuco dye 100A within the recording layer 113*b* thereby arrives at a writing temperature due to heat generated from the photothermal conversion agent 100B, and develops cyan by being combined with the developer. A cyan development density depends on strength of the laser beam Lb having the emission wavelength of 860 nm. Furthermore, for example, the laser beam Lc having the emission wavelength of 915 nm is absorbed into the photothermal conversion agent 100B within the recording layer 113*a*, and the leuco dye 100A within the recording layer 113*a* arrives at a writing temperature due to heat generated from the photothermal conversion agent 100B, and develops magenta by being combined with the developer. A magenta development density depends on strength of the laser beam Lc having the emission wavelength of 915 nm. As a result, due to color mixture of yellow, cyan, and magenta, a desirable color develops. In this way, the rendering apparatus 1 writes information in the reversible recording medium 100.

[Erasing]

First, the reversible recording medium 100 in which information is written in the manner described above is prepared, and set in the erasing apparatus 1 (step S101, FIG. 4). Next, the rendering apparatus 1 outputs, for example, a laser beam from at least one light source among the light source 31A, the light source 31B, and the light source 31C, and scans the laser beam on the reversible recording medium 100 (step S102, FIG. 4). At this moment, in a case where a laser beam is outputted from each of at least two light sources among the light source 31A, the light source 31B, and the light source 31C, the light source unit 30 multiplexes the laser beams outputted from the two light sources, and outputs the multiplexed laser beam. Further, when erasing the information written in the reversible recording medium 100, the light source unit 30 outputs a laser beam under a condition that the temperature of the recording layer 113 to be subjected to erasing is set to be a temperature that is a discoloring temperature or higher and is lower than the color developing temperature due to heat generation by the photothermal conversion agent 100B.

As a result, in a case where the laser beam emitted to the reversible recording medium 100 includes the laser beam La having the emission wavelength of 800 nm, the laser beam La having the emission wavelength of 800 nm is absorbed into the photothermal conversion agent 100B within the recording layer 113*c*, and the leuco dye 100A within the recording layer 113*c* thereby arrives at a temperature that is the discoloring temperature or higher and is lower than the developing temperature due to heat generated from the photothermal conversion agent 100B, and discolors by being separated from the developer. Here, the heat generated from the photothermal conversion agent 100B within the recording layer 113*c* propagates to each of the recording layers 113, and in a case where the leuco dye 100A within each of the recording layers 113 arrives at the temperature that is the discoloring temperature or higher and is lower than the developing temperature, the leuco dye 100A within each of the recording layers 113 discolors by being separated from the developer.

Further, in a case where the laser beam emitted to the reversible recording medium 100 includes the laser beam Lb having the emission wavelength of 860 nm, the laser beam Lb having the emission wavelength of 860 nm is absorbed into the photothermal conversion agent 100B within the recording layer 113*b*, and the leuco dye 100A within the recording layer 113*b* thereby arrives at a temperature that is the discoloring temperature or higher and is lower than the developing temperature due to heat generated from the photothermal conversion agent 100B, and discolors by being separated from the developer. Here, the heat generated from the photothermal conversion agent 100B within the recording layer 113*b* propagates to each of the recording layers 113, and in a case where the leuco dye 100A within each of the recording layers 113 arrives at the temperature that is the discoloring temperature or higher and is lower than the developing temperature, the leuco dye 100A within each of the recording layers 113 discolors by being separated from the developer.

Furthermore, in a case where the laser beam emitted to the reversible recording medium 100 includes the laser beam Lc having the emission wavelength of 915 nm, the laser beam Lc having the emission wavelength of 915 nm is absorbed into the photothermal conversion agent 100B within the recording layer 113*a*, and the leuco dye 100A within the recording layer 113*a* thereby arrives at a temperature that is the discoloring temperature or higher and is lower than the developing temperature due to heat generated from the photothermal conversion agent 100B, and discolors by being separated from the developer. Here, the heat generated from the photothermal conversion agent 100B within the recording layer 113*a* propagates to each of the recording layers 113, and in a case where the leuco dye 100A within each of the recording layers 113 arrives at the temperature that is the discoloring temperature or higher and is lower than the developing temperature, the leuco dye 100A within each of the recording layers 113 discolors by being separated from the developer. In this way, the rendering apparatus 1 erases the information in the reversible recording medium 100.

Incidentally, the rendering apparatus 1 has a control mechanism that controls an energy density [W/cm$^2$] on the reversible recording medium 100 so that the energy density [W/cm$^2$] on the reversible recording medium 100 when erasing the information written in the reversible recording medium 100 is smaller than an energy density [W/cm$^2$] on the reversible recording medium 100 when performing writing in the reversible recording medium 100.

For example, the signal processing circuit 10 and the laser driving circuit 20 may include a mechanism that controls the light source unit 30 so that a laser power in erasing of the light source unit 30 (e.g., the light source 31A, the light source 31B, and the light source 31C) is smaller than a laser power in writing of the light source unit 30, as the above-described control mechanism. For example, as illustrated in FIG. 5(A), the signal processing circuit 10 and the laser driving circuit 20 may control the peak value of the current pulse to be supplied to the light source unit 30, etc. so that a peak value of an output pulse from the light source unit 30 is W1, when performing writing in the reversible recording medium 100. Further, for example, as illustrated in FIG. 5(B), the signal processing circuit 10 and the laser driving circuit 20 may control the peak value of the current pulse to be supplied to the light source unit 30, etc. so that the peak value of the output pulse from the light source unit 30 is W2 (W2<W1), when performing erasing of the reversible recording medium 100.

Further, for example, the signal processing circuit 10 and the laser driving circuit 20 may control the light source unit 30 so that an irradiation time ΔT2 of a laser pulse in erasing of the light source unit 30 (e.g., the light source 31A, the light source 31B, and the light source 31C) is shorter than an irradiation time ΔT1 in writing of the light source unit 30, as the above-described control mechanism. For example, as illustrated in FIG. 6(A), the signal processing circuit 10 and the laser driving circuit 20 may control a pulse width of a current pulse to be supplied to the light source unit 30, etc. so that the irradiation time (the pulse width) of the laser pulse in writing of the light source unit 30 (e.g., the light source 31A, the light source 31B, and the light source 31C) is ΔT1, when performing writing in the reversible recording medium 100. Furthermore, for example, as illustrated in FIG. 6(B), the signal processing circuit 10 and the laser driving circuit 20 may control the pulse width of the current pulse to be supplied to the light source unit 30, etc. so that the irradiation time (the pulse width) of the laser pulse in erasing of the light source unit 30 (e.g., the light source 31A, the light source 31B, and the light source 31C) is ΔT2 (ΔT2<ΔT1), when performing erasing of the reversible recording medium 100.

Furthermore, for example, the signal processing circuit 10 and the laser driving circuit 20 may control the light source unit 30 so that the laser pulse in erasing of the light source unit 30 (e.g., the light source 31A, the light source 31B, and the light source 31C) has a rectangular shape, and the laser pulse in writing of the light source unit 30 has a waveform different from a waveform in erasing, as the above-described control mechanism. For example, as illustrated in FIG. 7(A), the signal processing circuit 10 and the laser driving circuit 20 may control the light source unit 30 so that the laser pulse in erasing of the light source unit 30 (e.g., the light source 31A, the light source 31B, and the light source 31C) has a rectangular shape. Further, for example, as illustrated in FIG. 7(B), the signal processing circuit 10 and the laser driving circuit 20 may control the light source unit 30 so that the laser pulse in writing of the light source unit 30 has a triangular shape.

Further, for example, the signal processing circuit 10 and the scanner driving circuit 50 may control the scanner driving circuit 50 so that a scan speed in erasing of the light source unit 30 (e.g., the light source 31A, the light source 31B, and the light source 31C) is higher than a scan speed in writing of the light source unit 30, as the above-described control mechanism.

Furthermore, for example, the adjustment mechanism 40 may include a mechanism that performs focus adjustment of the laser beam La, the laser beam Lb, and the laser beam Lc, or the multiplexed light beam Lm, as the above-described control mechanism. For example, as illustrated in FIG. 8(A), the signal processing circuit 10 and the laser driving circuit 20 may adjust the lens 32*e* so that a spot diameter in writing of the light source unit 30 (e.g., the light source 31A, the light source 31B, and the light source 31C) is ΔD1. Further, for example, as illustrated in FIG. 8(B), the signal processing circuit 10 and the laser driving circuit 20 may adjust the lens 32*e* so that a spot diameter in erasing of the light source unit 30 is ΔD2 (ΔD2>ΔD1).

EXAMPLES

Next, Examples of the rendering apparatus 1 according to the present embodiment are described in comparison with comparative examples. FIG. 9 and FIG. 10 illustrate experimental results of the rendering apparatus 1 according to Examples. FIG. 11, FIG. 12, and FIG. 13 illustrate experimental results of a rendering apparatus according to the comparative examples. Examples 1 to 10 illustrated in FIG. 9 are results of experiments in writing, and Examples 11 to 20 illustrated in FIG. 10 are results of experiments in erasing.

Examples 1, 8 to 10, and 11

With respect to the reversible recording medium 100, writing and erasing were performed on conditions described below, and a reflection density (OD) was measured. In writing, a solid image was written in the reversible recording medium 100, under conditions of an output of 2 W, a spot diameter of 70 μm, and a scan speed of 5 m/sec for each of the emission wavelengths 800 nm, 860 nm, and 915 nm, and a reflection density was measured. In erasing, a solid image written in the reversible recording medium 100 was erased, under conditions of an output of 2 W, a spot diameter of 500 μm, and a scan speed of 0.5 m/sec for each of the emission wavelengths 800 nm, 860 nm, and 915 nm, and a reflection density after erasing was measured.

Examples 2 to 7

In Examples 2 to 7 illustrated in FIG. 9, there was measured a reflection density after writing when laser irradiation was performed with respect to the reversible recording medium 100 under a condition changed from each of the laser power, the spot diameter, and the scan speed of Example 1 illustrated in FIG. 9.

Examples 12 to 20

In Examples 12 to 20 illustrated in FIG. 10, there was measured a reflection density after erasing when laser irradiation was performed under a condition changed from each of the laser power, the spot diameter, and the scan speed, with respect to the reversible recording medium 100 for which writing was performed in Examples 2 to 10 illustrated in FIG. 9.

In any of Examples 11 to 20, the reflection density was 0.2 or less, and the solid image written in the reversible recording medium 100 was erased. In Examples 18 and 19, the energy density of a laser beam that irradiates the recording medium 100 was reduced to be less than the energy density in writing, by increasing the spot diameter, etc. In this way, rewriting is enabled in the same apparatus by adjusting writing conditions and erasing conditions.

FIG. 11 illustrates a reflection density of a solid image obtained by performing another laser irradiation from short wavelength side, under the same conditions as the conditions in each of Examples 1, 5, 6, and 7. In any of comparative examples 1 to 4, as compared with Examples, the reflection density decreased, and it was found that a power of about 2.5 W was necessary to obtain an equivalent reflection density. In addition, it is necessary that a point at which each of the laser beams is irradiated be on the same line, and it is desirable that alignment accuracy also be ±2 μm or less, and to realize this, apparatus cost increases.

FIG. 12 illustrates a reflection density when another laser irradiation was performed from short wavelength side, under the same conditions as the conditions in each of Examples 11, 15, 16, and 17. In any of comparative examples 5 to 8, the reflection density indicates 0.2 or more, and erasing is not sufficient. To perform erasing equivalent to Examples, irradiation using a power of about 2.5 W is necessary, or it is necessary to reduce the scan speed to about 0.3 m/s, and thus, it is disadvantageous in terms of power consumption and takt.

FIG. 13 illustrates a reflection density when an image was rendered under the conditions of Example 1 and the image was erased by a ceramic bar for erasing that is mounted on a heat-sensitive printer. When the scan speed is reduced and a sufficient amount of heat is applied, a base material (ABS) deforms. On the other hand, when the scan speed is increased to suppress heat deformation, an unerased portion appears. In view of the above-described results, it is preferable to perform erasing using a laser, when performing erasing for a base material having a low heat-resistant temperature.

[Effects]

Next, effects of the rendering apparatus 1 according to the present embodiment is described.

A recording medium employing a heat-sensitive method and using a heat-sensitive color developing composition such as a leuco dye has become widespread. Currently, for such a recording medium, an irreversible recording medium not enabling data to be erased once written, and a reversible recording medium enabling repeated rewriting have become practical. As for the reversible recording medium, while monochromatic display has become practical, full color display has not yet become practical. Incidentally, when an excessive amount of heat is applied to a recording medium employing a heat-sensitive method during writing or erasing, there is a possibility that the recording medium deforms.

In contrast, in the rendering apparatus 1 according to the present embodiment, the laser beams outputted from the plurality of light sources (e.g., 31A, 31B, and 31C) varying in emission wavelength in the near infrared region are multiplexed, and scanning of the multiplexed light beam Lm obtained thereby is performed on the reversible recording medium 100. In this way, driving the light sources simultaneously increases writing efficiency or erasing efficiency in terms of thermal diffusion, as compared with a case where each of the light sources is driven in temporally independently. This reduces energy necessary for writing and erasing. As a result, it is possible to suppress deformation of the reversible recording medium 100.

Further, in the rendering apparatus 1 according to the present embodiment, the laser beam is outputted under the condition that the temperature of the recording layer 113 to be subjected to writing is set to be the color developing temperature or higher due to heat generation by the photothermal conversion agent 100B, when writing with respect to the reversible recording medium 100 is performed. This makes it possible to perform laser irradiation using an energy density necessary for writing, and suppress deformation of the reversible recording medium 100.

Furthermore, in the rendering apparatus 1 according to the present embodiment, the laser beam is outputted under the condition that the temperature of the recording layer 113 to be subjected to erasing is set to be the temperature that is the discoloring temperature or higher and is lower than the color developing temperature due to heat generation by the photothermal conversion agent 100B, when erasing information written in the reversible recording medium 100 is performed. This makes it possible to perform laser irradiation using an energy density necessary for erasing, and suppress deformation of the reversible recording medium 100.

In addition, in the rendering apparatus 1 according to the present embodiment, the energy density [W/cm$^2$] on the reversible recording medium 100 when erasing information written in the reversible recording medium 100 is performed is controlled to be smaller than the energy density [W/cm$^2$] on the reversible recording medium 100 when writing in the reversible recording medium 100 is performed. This makes it possible to perform laser irradiation using an energy density necessary for writing and erasing, and suppress deformation of the reversible recording medium 100.

Moreover, in the rendering apparatus 1 according to the present embodiment, each of the light sources (e.g., 31A, 31B, and 31C) is controlled so that the laser power in erasing of each of the light sources (e.g., 31A, 31B, and 31C) is smaller than the laser power in writing of each of the light sources (e.g., 31A, 31B, and 31C). This makes it possible to erase information written in the reversible recording medium 100.

Further, in the rendering apparatus 1 according to the present embodiment, each of the light sources (e.g., 31A, 31B, and 31C) is controlled so that the irradiation time ΔT2 of the laser pulse in erasing of each of the light sources (e.g., 31A, 31B, and 31C) is shorter than the irradiation time ΔT1 in writing of each of the light sources (e.g., 31A, 31B, and 31C). This enables the energy density [W/cm$^2$] on the reversible recording medium 100 when erasing the information written in the reversible recording medium 100 to be smaller than the energy density [W/cm$^2$] on the reversible recording medium 100 when performing writing in the reversible recording medium 100. As a result, it is possible to perform laser irradiation using an energy density necessary for writing and erasing, and suppress deformation of the reversible recording medium 100.

Furthermore, in the rendering apparatus 1 according to the present embodiment, each of the light sources (e.g., 31A, 31B, and 31C) is controlled so that the laser pulse in erasing of each of the light sources (e.g., 31A, 31B, and 31C) has a rectangular shape, and the laser pulse in writing of each of the light sources (e.g., 31A, 31B, and 31C) has a waveform different from a waveform in erasing. This enables the energy density [W/cm$^2$] on the reversible recording medium 100 when erasing the information written in the reversible recording medium 100 to be smaller than the energy density [W/cm$^2$] on the reversible recording medium 100 when performing writing in the reversible recording medium 100. As a result, it is possible to perform laser irradiation using an energy density necessary for writing and erasing, and suppress deformation of the reversible recording medium 100.

In addition, in the rendering apparatus 1 according to the present embodiment, the scanner driving circuit 50 is controlled so that the scan speed in erasing of each of the light sources (e.g., 31A, 31B, and 31C) is higher than the scan speed in writing of each of the light sources (e.g., 31A, 31B, and 31C). This enables the energy density [W/cm$^2$] on the reversible recording medium 100 when erasing the information written in the reversible recording medium 100 to be smaller than the energy density [W/cm$^2$] on the reversible recording medium 100 when performing writing in the reversible recording medium 100. As a result, it is possible to perform laser irradiation using an energy density necessary for writing and erasing, and suppress deformation of the reversible recording medium 100.

Moreover, in the rendering apparatus 1 according to the present embodiment, the adjustment mechanism 40 that performs the focus adjustment of the laser beam La, the laser beam Lb, the laser beam Lc, or the multiplexed light beam Lm is provided. This enables the energy density [W/cm$^2$] on the reversible recording medium 100 when erasing the information written in the reversible recording medium 100 to be smaller than the energy density [W/cm$^2$] on the reversible recording medium 100 when performing writing in the reversible recording medium 100, by making the focus relatively small in writing, and relatively large in erasing. As a result, it is possible to perform laser irradiation using an energy density necessary for writing and erasing, and suppress deformation of the reversible recording medium 100.

Although the disclosure has been described above referring to the embodiment and modification examples, the disclosure is not limited thereto, and may be modified in a variety of ways.

For example, in the foregoing embodiment, etc., the recording layer 113 and the heat insulating layer 114 are laminated alternately in the reversible recording medium 100, but, for example, the reversible recording medium 100 may include a micro capsule including the leuco dye 100A and the photothermal conversion agent 100B. Further, for example, in the foregoing embodiment, etc., each of the recording layers 113 (113*a*, 113*b*, and 113*c*) includes the leuco dye 100A as the reversible heat-sensitive color developing composition, but may include a material different from the leuco dye 100A. Furthermore, for example, in the foregoing embodiment, etc., the rendering apparatus 1 is configured to perform writing and erasing of information with respect to the reversible recording medium 100, but may be configured to perform one or both of writing and erasing of information with respect to the reversible recording medium 100.

It is to be noted that the effects described in the present specification are merely exemplified. The effects of the present disclosure are not limited to those described in the present specification. The present disclosure may include effects other than those described in the present specification.

It is to be noted that the present disclosure may have the following configurations.

(1)

An optical apparatus that performs one or both of writing and erasing of information with respect to an information recording section including a plurality of recording portions including a reversible heat-sensitive color developing composition and a photothermal conversion agent, the reversible heat-sensitive color developing compositions varying in developed-color tone, and the photothermal conversion agents varying in absorption wavelength in a near infrared region (700 nm to 2500 nm), the optical apparatus including:

a plurality of laser devices varying in emission wavelength in a near infrared region;

an optical system that multiplexes laser beams outputted from the plurality of laser devices; and a scanner unit that scans a multiplexed light beam obtained by multiplexing by the optical system, on the information recording section.

(2)

The optical apparatus according to (1), in which the laser devices each output a laser beam under a condition that a temperature of the recording portion to be subjected to writing is set to be a color developing temperature or higher due to heat generation by the photothermal conversion agent, when performing writing with respect to the information recording section.

(3)

The optical apparatus according to (2), in which the laser devices each output a laser beam under a condition that a temperature of the recording portion to be subjected to erasing is set to be a temperature that is a discoloring temperature or higher and is lower than a color developing temperature due to heat generation by the photothermal conversion agent, when performing erasing of information written in the information recording section.

(4)

The optical apparatus according to (3), further including a control mechanism that controls an energy density [W/cm$^2$] on the information recording section to have an energy density [W/cm$^2$] on the information recording section when erasing information written in the information recording section is performed being smaller than an energy density [W/cm$^2$] on the information recording section when writing in the information recording section is performed.

(5)

The optical apparatus according to (4), in which the control mechanism is a laser driving circuit that controls each of the laser devices to have a laser power in erasing of each of the laser devices being smaller than a laser power in writing of each of the laser devices.

(6)

The optical apparatus according to (4), in which the control mechanism is a laser driving circuit that controls each of the laser devices to have an irradiation time of a laser pulse in erasing of each of the laser devices being shorter than an irradiation time in writing of each of the laser devices.

(7)

The optical apparatus according to (4), in which the control mechanism is a laser driving circuit that controls each of the laser devices to form a laser pulse in erasing of each of the laser devices in a rectangular shape, and a laser pulse in writing of each of the laser devices in a waveform different from a waveform in erasing.

(8)

The optical apparatus according to (4), in which the control mechanism is a scanner driving circuit that controls the scanner unit to have a scan speed in erasing of each of the laser devices being higher than a scan speed in writing of each of the laser devices.

(9)

The optical apparatus according to (4), in which the control mechanism is a mechanism that performs focus adjustment of the multiplexed light beam.

(10)

A rendering and erasing apparatus including:

a plurality of laser devices varying in emission wavelength in a near infrared region (700 nm to 2500 nm);

an optical system that multiplexes laser beams outputted from the plurality of laser devices; and a scanner unit that scans a multiplexed light beam obtained by multiplexing by the optical system, on the information recording section.

(11)

An irradiation method including:

performing, with respect to an information recording section including a plurality of recording portions including a reversible heat-sensitive color developing composition and a photothermal conversion agent, the reversible heat-sensitive color developing compositions varying in developed-color tone, and the photothermal conversion agents varying in absorption wavelength in a near infrared region (700 nm to 2500 nm), one or both of writing and erasing of information, by multiplexing laser beams outputted from a plurality of laser devices varying in emission wavelength in a near infrared region, and scanning a multiplexed light beam obtained thereby, on the information recording section.

This application claims the benefit of Japanese Priority Patent Application JP2017-113452 filed with the Japan Patent Office on Jun. 8, 2017, the entire contents of which are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. An optical apparatus that performs one or both of writing and erasing of information with respect to a reversible recording medium including a plurality of recording portions including a reversible heat-sensitive color developing composition and a photothermal conversion agent, the reversible heat-sensitive color developing composition varying in developed-color tone for each of the recording portions, and the photothermal conversion agent varying in absorption wavelength for each of the recording portions in a near infrared region (700 nm to 2500 nm), the optical apparatus comprising:

a plurality of laser devices varying in emission wavelength in a near infrared region;

an optical system that multiplexes laser beams outputted from the plurality of laser devices; and a scanner unit that scans a multiplexed light beam obtained by multiplexing by the optical system, on the reversible recording medium, wherein the laser devices each output a laser beam under a condition that a temperature of the recording portion to be subjected to writing is set to be a color developing temperature or higher due to heat generation by the photothermal conversion agent, when performing writing with respect to the reversible recording medium, and wherein the laser devices each output a laser beam under a condition that a temperature of the recording portion to be subjected to erasing is set to be a temperature that is a discoloring temperature or higher and is lower than the color developing temperature due to heat generation by the photothermal conversion agent, when performing erasing of information written in the reversible recording medium.

2. The optical apparatus according to claim 1, further comprising a control mechanism that controls an energy density [W/cm$^2$] on the reversible recording medium to have an energy density [W/cm$^2$] on the reversible recording medium when erasing information written in the reversible recording medium is performed being smaller than an energy density [W/cm$^2$] on the reversible recording medium when writing in the reversible recording medium is performed.

3. The optical apparatus according to claim 2, wherein the control mechanism is a laser driving circuit that controls each of the laser devices to have a laser power in erasing of each of the laser devices being smaller than a laser power in writing of each of the laser devices.

4. The optical apparatus according to claim 2, wherein the control mechanism is a laser driving circuit that controls each of the laser devices to have an irradiation time of a laser pulse in erasing of each of the laser devices being shorter than an irradiation time in writing of each of the laser devices.

5. The optical apparatus according to claim 2, wherein the control mechanism is a laser driving circuit that controls each of the laser devices to form a laser pulse in erasing of each of the laser devices in a rectangular shape, and a laser pulse in writing of each of the laser devices in a waveform different from a waveform in erasing.

6. The optical apparatus according to claim 2, wherein the control mechanism is a scanner driving circuit that controls the scanner unit to have a scan speed in erasing of each of the laser devices being higher than a scan speed in writing of each of the laser devices.

7. The optical apparatus according to claim 2, wherein the control mechanism is a mechanism that performs focus adjustment of the multiplexed light beam.

8. A rendering and erasing apparatus comprising:

a plurality of laser devices varying in emission wavelength in a near infrared region (700 nm to 2500 nm);

an optical system that multiplexes laser beams outputted from the plurality of laser devices; and a scanner unit that scans a multiplexed light beam obtained by multiplexing by the optical system, on a reversible recording medium including a plurality of recording portions varying in developed-color tone, wherein the laser devices each output a laser beam under a condition that a temperature of the recording portion to be subjected to writing is set to be a color developing temperature or higher due to heat generation by the photothermal conversion agent, when performing writing with respect to the reversible recording medium, and wherein the laser devices each output a laser beam under a condition that a temperature of the recording portion to be subjected to erasing is set to be a temperature that is a discoloring temperature or higher and is lower than the color developing temperature due to heat generation by the photothermal conversion agent, when performing erasing of information written in the reversible recording medium.

9. An irradiation method comprising:

performing, with respect to a reversible recording medium including a plurality of recording portions including a reversible heat-sensitive color developing composition and a photothermal conversion agent, the reversible heat-sensitive color developing composition varying in developed-color tone for each of the recording portions, and the photothermal conversion agent varying in absorption wavelength for each of the recording portions in a near infrared region (700 nm to 2500 nm), one or both of writing and erasing of information, by multiplexing laser beams outputted from a plurality of laser devices varying in emission wavelength in a near infrared region, and scanning a multiplexed light beam obtained thereby, on the reversible recording medium, wherein the laser devices each output a laser beam under a condition that a temperature of the recording portion to be subjected to writing is set to be a color developing temperature or higher due to heat generation by the photothermal conversion agent, when performing writing with respect to the reversible recording medium, and wherein the laser devices each output a laser beam under a condition that a temperature of the recording portion to be subjected to erasing is set to be a temperature that is a discoloring temperature or higher and is lower than the color developing temperature due to heat generation by the photothermal conversion agent, when performing erasing of information written in the reversible recording medium.

* * * * *